US006734349B1

(12) United States Patent
Adams

(10) Patent No.: US 6,734,349 B1
(45) Date of Patent: May 11, 2004

(54) FINGERTIP MUSICAL TAP ASSEMBLY

(76) Inventor: Conrad Adams, 101-125 147$^{th}$ St., New York City, NY (US) 10039

( * ) Notice: Subject to any disclaimer, the term of this patent is extended or adjusted under 35 U.S.C. 154(b) by 0 days.

(21) Appl. No.: 10/392,807

(22) Filed: Mar. 21, 2003

(51) Int. Cl.$^{7}$ ..... G10D 3/16
(52) U.S. Cl. ..... 84/322; 84/315
(58) Field of Search ..... 84/322, 315, 316, 84/317

(56) References Cited

U.S. PATENT DOCUMENTS

| | | | | |
|---|---|---|---|---|
| 1,885,843 A | | 11/1932 | Langer | |
| 2,780,954 A | | 2/1957 | Bryee | |
| 3,027,794 A | | 4/1962 | Chute | |
| 3,046,561 A | | 7/1962 | Marinese et al. | |
| 4,102,234 A | * | 7/1978 | Brundage | 84/322 |
| 4,681,012 A | | 7/1987 | Stelma et al. | |
| D422,121 S | | 3/2000 | Peck | |

* cited by examiner

*Primary Examiner*—Kimberly Lockett

(57) ABSTRACT

A fingertip musical tap assembly for producing a clicking sound when the user's fingers are tapped on hard surfaces. The fingertip musical tap assembly includes straps being adapted to be fastenable about fingertips of a user; and also includes fastening members being attached at ends of the straps for fastening the straps about the user's fingertips; and further includes clicking sound-making support members being supported upon the straps; and also includes clicking sound-making members being attached to the clicking sound-making support members for producing a clicking sound upon being tapped upon a hard surface.

4 Claims, 2 Drawing Sheets

17
14
11
17
14
11
17
14
11

FINGERTIP MUSICAL TAP ASSEMBLY

BACKGROUND OF THE INVENTION

1. Field of the Invention

The present invention relates to fingertip musical taps and more particularly pertains to a new fingertip musical tap assembly for producing a clicking sound when the user's fingers are tapped on hard surfaces.

2. Description of the Prior Art

The use of fingertip musical taps is known in the prior art. More specifically, fingertip musical taps heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 1,885,843; U.S. Pat. No. Des. 422,121; U.S. Pat. No. 3,027,794; U.S. Pat. No. 3,046,561; U.S. Pat. No. 2,780,954; and U.S. Pat. No. 4,681,012.

While these devices fulfill their respective, particular objectives and requirements, the aforementioned patents do not disclose a new fingertip musical tap assembly. The prior art includes inventions having fingertip protectors or sheathes adapted to fit about one's fingertips.

SUMMARY OF THE INVENTION

The general purpose of the present invention, which will be described subsequently in greater detail, is to provide a new fingertip musical tap assembly which has many of the advantages of the fingertip musical taps mentioned heretofore and many novel features that result in a new fingertip musical tap assembly which is not anticipated, rendered obvious, suggested, or even implied by any of the prior art fingertip musical taps, either alone or in any combination thereof. The present invention includes straps being adapted to be fastenable about fingertips of a user; and also includes fastening members being attached at ends of the straps for fastening the straps about the user's fingertips; and further includes clicking sound-making support members being supported upon the straps; and also includes clicking sound-making members being attached to the clicking sound-making support members for producing a clicking sound upon being tapped upon a hard surface. None of the prior art describes the combination of the elements of the present invention.

There has thus been outlined, rather broadly, the more important features of the fingertip musical tap assembly in order that the detailed description thereof that follows may be better understood, and in order that the present contribution to the art may be better appreciated. There arc additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new fingertip musical tap assembly which has many of the advantages of the fingertip musical taps mentioned heretofore and many novel features that result in a new fingertip musical tap assembly which is not anticipated, rendered obvious, suggested, or even implied by any of the prior art fingertip musical taps, either alone or in any combination thereof.

Still another object of the present invention is to provide a new fingertip musical tap assembly for producing a clicking sound when the user's fingers are tapped on hard surfaces.

Still yet another object of the present invention is to provide a new fingertip musical tap assembly that is easy and convenient to put on and use.

Even still another object of the present invention is to provide a new fingertip musical tap assembly that relieves stress for the user and can be easily put on and taken off.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
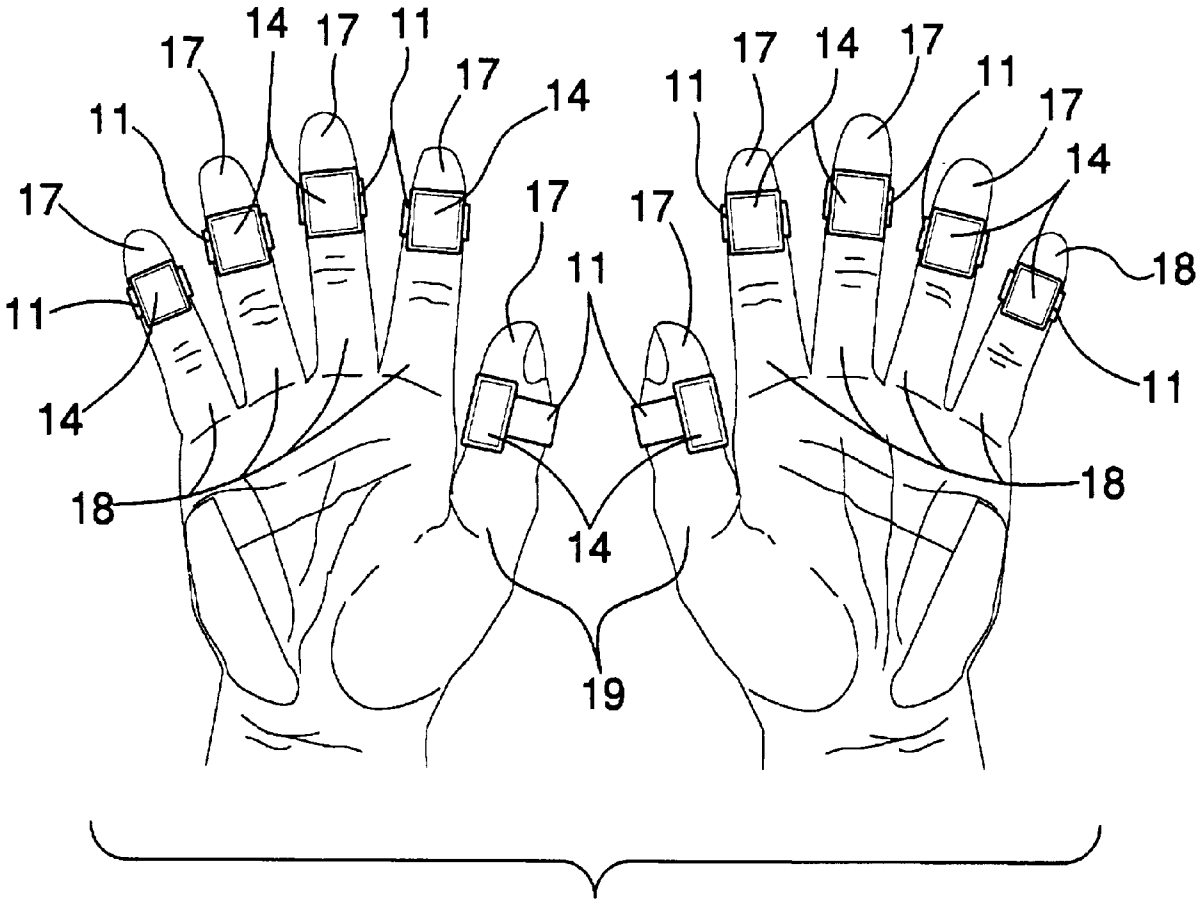
FIG. 1 is a front view of a new fingertip musical tap assembly according to the present invention.
Figure 2:
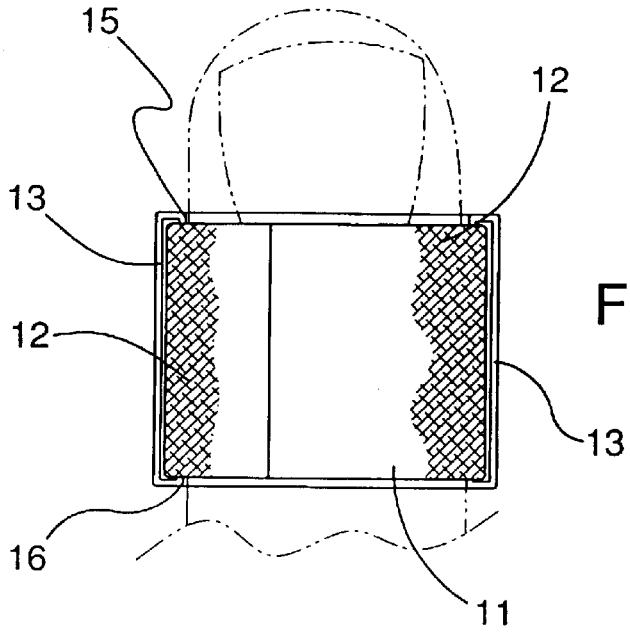
FIG. 2 is a back elevational view of the present invention.
Figure 3:
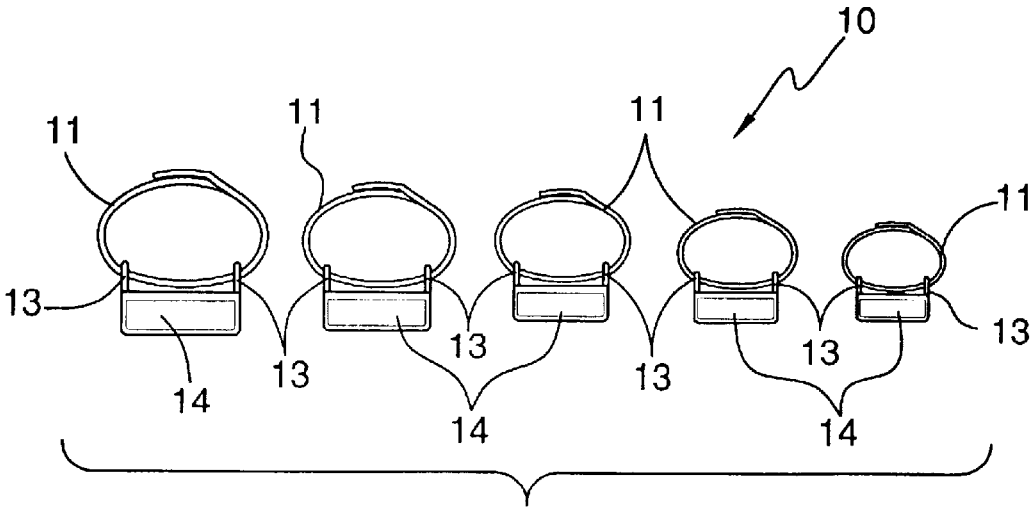
FIG. 3 is a top plan view of the present invention.

With reference now to the drawings, and in particular to FIGS. 1 through 3 thereof, a new fingertip musical tap assembly embodying the principles and concepts of the present invention and generally designated by the reference numeral 10 will be described.

As best illustrated in FIGS. 1 through 3, the fingertip musical tap assembly 10 generally comprises straps 11 being adapted to be fastenable about fingertips 17 of a user. Fastening members 12 are conventionally attached at ends of the straps 11 for fastening the straps 11 about the user's fingertips 17. The fastening members 12 are strips of hook and loop fasteners being attached at and near ends of the straps 11. Clicking sound-making support members 13 are conventionally supported upon the straps 11. The clicking sound-making support members 13 are flexible loop members.

Clicking sound-making members 14 are conventionally attached to the clicking sound-making support members 13 for producing a clicking sound upon being tapped upon a hard surface. The clicking sound-making members 14 are small metallic plates with pairs of the flexible loop members 13 having ends which are securely and conventionally attached along edges 15,16 of a respective small metallic plate 14. Each of the straps 11 is removably disposed through a respective pair of the loop members 13. Each of the small metallic plates 14 is a quadrilateral and has a thickness of approximately ⅛ inch and has a width generally equivalent to a width of a user's finger 18 and thumb 19 depending upon which of a finger 18 and thumb 19 the small metallic plates 14 are desired.

In use, the users straps the fingertip musical tap assembly 10 about the fingertips 17 of one's fingers 18 and thumbs 19 with the metallic plates 14 being positioned upon the user's fingertips 17 so that the user can tap the metallic plates 14 upon a hard surface to make the clicking sounds.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the fingertip musical tap assembly. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A fingertip musical tap assembly comprising:

straps being adapted to be fastenable about fingertips of a user;

fastening members being attached at ends of said straps for fastening said straps about the user's fingertips, said fastening members being strips of hook and loop fasteners being attached at and near ends of said straps;

clicking sound-making support members being supported upon said straps, said clicking sound-making support members being flexible loop members; and clicking sound-making members being attached to said clicking sound-making support members for producing a clicking sound upon being tapped upon a hard surface.

2. The fingertip musical tap assembly as described in claim 1, wherein said clicking sound-making members are small metallic plates, pairs of said flexible loop members having ends which are securely attached to edges of a respective said small metallic plate.

3. The fingertip musical tap assembly as described in claim 2, wherein each of said straps is removably disposed through a respective pair of said loop members.

4. The fingertip musical tap assembly as described in claim 3, wherein each of said small metallic plates is a quadrilateral and has a thickness of approximately ⅛ inch and has a width generally equivalent to a width of a user's finger and thumb depending upon which of a finger and thumb said small metallic plates are desired.

* * * * *